US007367928B2

(12) United States Patent
Storch

(10) Patent No.: US 7,367,928 B2
(45) Date of Patent: May 6, 2008

(54) EXERCISE DEVICE

(76) Inventor: Shimon Storch, 13 Yair St, Zichron Yaakov (IL) 30900

( * ) Notice: Subject to any disclaimer, the term of this patent is extended or adjusted under 35 U.S.C. 154(b) by 11 days.

(21) Appl. No.: 11/467,680

(22) Filed: Aug. 28, 2006

(65) Prior Publication Data

US 2008/0051273 A1 Feb. 28, 2008

(51) Int. Cl.
*A63B 26/00* (2006.01)

(52) U.S. Cl. ..... 482/141; 482/62

(58) Field of Classification Search ..... 482/141, 482/62; D21/662, 665
See application file for complete search history.

(56) References Cited

U.S. PATENT DOCUMENTS 3,572,701 A * 3/1971 Agamian ..... 482/132
3,767,191 A * 10/1973 Riley ..... 482/25
3,784,192 A * 1/1974 Nutter ..... 482/132
4,595,197 A * 6/1986 Hagstrom et al. ..... 482/132
5,004,229 A * 4/1991 Lind ..... 482/132
5,217,487 A * 6/1993 Engel et al. ..... 606/240
5,582,565 A * 12/1996 Soria ..... 482/141
6,196,954 B1 * 3/2001 Chen ..... 482/131
6,440,045 B1 * 8/2002 Gaston ..... 482/140
6,500,105 B1 * 12/2002 Kuo ..... 482/123
6,626,807 B1 * 9/2003 Richmond ..... 482/123
6,695,754 B1 * 2/2004 Gazzolo ..... 482/141
6,746,383 B2 * 6/2004 Yu ..... 482/127
6,780,144 B2 * 8/2004 Stevens ..... 482/91
6,945,919 B2 * 9/2005 Yang ..... 482/142
7,060,014 B2 * 6/2006 Bergman et al. ..... 482/141
2006/0040808 A1 * 2/2006 Riazi ..... 482/141
2006/0189438 A1 * 8/2006 Black ..... 482/8

* cited by examiner

*Primary Examiner*—Lori Amerson
(74) *Attorney, Agent, or Firm*—Lilling & Lilling PLLC

(57) ABSTRACT

An apparatus is disclosed for performing pushups thereupon. It includes a foot supporter coupled via a connecting means to a hand supporter. The foot supporter has front and back pieces pivotably coupled at a join via a double axle coupled by a short connector and a foot support bar comprising a crosspiece and support legs attached thereto. Therefore, the height of the crosspiece above said surface may be varied between a lowered position and a raised position. This device is compact and portable and is used for performing more effective push-ups.

14 Claims, 5 Drawing Sheets

EXERCISE DEVICE

BACKGROUND OF THE INVENTION

1. Field of the Invention

The present invention is directed to providing an exercise device, particularly a compact and portable device for performing more effective push-ups.

2. Description of the Prior Art

The Push-Up is one of the world's oldest exercises and is one of the best ways to strengthen and build up upper body strength, including chest, shoulders, arms abdomen and lower back muscles when done correctly. In particular, push-ups are a favorite exercise for developing strength in biceps, triceps and abdominal muscles, for body-building, fitness and for weight control.

Conventional push-ups are performed whilst lying chest-down with hands at shoulder level and palms flat on the floor and slightly more than shoulder-width apart and feet together and parallel to each other. Keeping the legs straight and toes tucked under the feet, the arms are straightened to push the body up off the floor. Keeping the palms fixed at the same position and the body straight without bending or arching the upper or lower back while pushing up, the exerciser should exhale as the arms straighten out. After a momentary pause, the exerciser slowly lowers the body towards the floor. Bending the arms while keeping the palms in a fixed position and keeping the body straight and feet together, the body is lowered until the chest touches the floor. Without bending the back, the knees are kept off the floor, the exerciser inhaling as the arms are bent. After pausing for a moment, the exerciser straightens the arms for a second push-up, exhaling whilst raising the body.

Indeed, push-ups and pull-ups are all that is needed to work the major upper body muscle groups. Members of the US Armed Forces, especially the army and the Marines, still depend on these two exercises, along with crunches and running, to stay in shape when they're stationed in a locale without a training facility.

There is, however, a known limitation with using just push-ups and pull-ups for upper body training that arises as the trainee's strength plateaus, in that with any exercise, whether using one's own body weight, free weights or machines, if the resistance doesn't increase, the muscles are not overloaded and the stimulus these fibers need to grow in size is missing.

There are, however, a few ways that have long been known, for increasing the resistance of pull-ups and push-ups. One way is to elevate the feet while doing push-ups. Essentially, one starts with the feet on a step at the bottom of a stair or a low step stool. Raising the feet higher make one work against gravity, thereby increasing the resistance. Ideally one should work up to the point where one can perform push-ups with one's feet on a chair. It will be noted that the higher the feet, the more work is done by the shoulders.

Other variations for improving strength and muscular endurance include modified push-ups with hands on an object or with feet on an object. With hands on an object, the difficulty of the exercise may be increased by first placing the hands on a wall, later on a desk, then on a chair (or by progressing to lower stairs on a staircase). By progressing to lower levels of hand placement, the intensity of the exercise is increased with a resultant increase in muscle strength. With feet on an object, the body is kept straight with hands on the ground and feet on a chair, steps, or some object. Progressively elevating the feet to higher levels increases the intensity of the exercise. The difficulty and hence strength may be further increased by doing push-ups between chairs with the feet elevated; the exerciser lowering himself/herself as far as possible between the chairs.

The present invention provides a compact apparatus for assisting an exerciser to perform variations of the standard push up, where stairs, stools and the like are unavailable, and provides controlled modular increase in difficulty and effectiveness for building up muscles, fitness and stamina, and a narrow patent is requested for this novel apparatus.

SUMMARY OF THE INVENTION

In a first aspect, the present invention is directed to providing an apparatus for performing pushups thereupon, the apparatus comprising a foot supporter coupled via a connecting means to a hand supporter.

Typically the foot supporter and hand supporter are for placing on a surface, wherein the foot supporter comprises front and back pieces pivotably coupled at a join and a foot support bar comprising a crosspiece and support legs attached thereto, such that height of the crosspiece above said surface may be varied between a lowered position and a raised position.

Preferably the hand supporter has handgrips thereon, that preferably are angled at about 45° to said surface.

When the foot supporter and the hand supporter are placed on a surface, in said raised position said crosspiece is situated further above said surface than are said handgrips of said hand supporter.

Preferably separation of the foot supporter from the hand supporter is variable by adjusting length of connecting means therebetween.

Optionally, said connecting means comprises a pair of straps.

Optionally, the length of said connecting means is variable by means of buckles for engaging different holes there-along.

Alternatively, said connecting means comprises a pair of telescopically extendible rods.

In preferred embodiments rubber grips are provided on undersurfaces of said foot supporter.

In preferred embodiments rubber grips are provided on undersurface of said hand supporter.

Typically the hands supporter resembles an inverted bicycle handlebar having handgrips angled at about 45° to said surface.

Optionally and preferably, the front and back pieces of said foot supporter are connected together via a double axle coupled by a short connector.

Optionally and preferably, the foot supporter further comprises a socket attached to said connector, for engaging vertical legs of said foot support bar by threading said legs therethrough, wherein optionally and preferably, the apparatus further comprises a plurality of holes through said legs and said socket for enabling altitude of the crosspiece above said surface to be set by a linchpin therethrough.

Most preferably, the foot supporter is foldable to assume a substantially flattened configuration.

BRIEF DESCRIPTION OF THE SEVERAL VIEWS OF THE DRAWINGS

For a better understanding of the invention and to show how it may be carried into effect, reference will now be made, purely by way of example, to the accompanying drawings.

With specific reference now to the drawings in detail, it is stressed that the particulars shown, are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawings making apparent to those skilled in the art how the several forms of the invention may be embodied in practice. In the accompanying drawings.

DETAILED DESCRIPTION OF THE PREFERRED EMBODIMENTS

Figure 1:
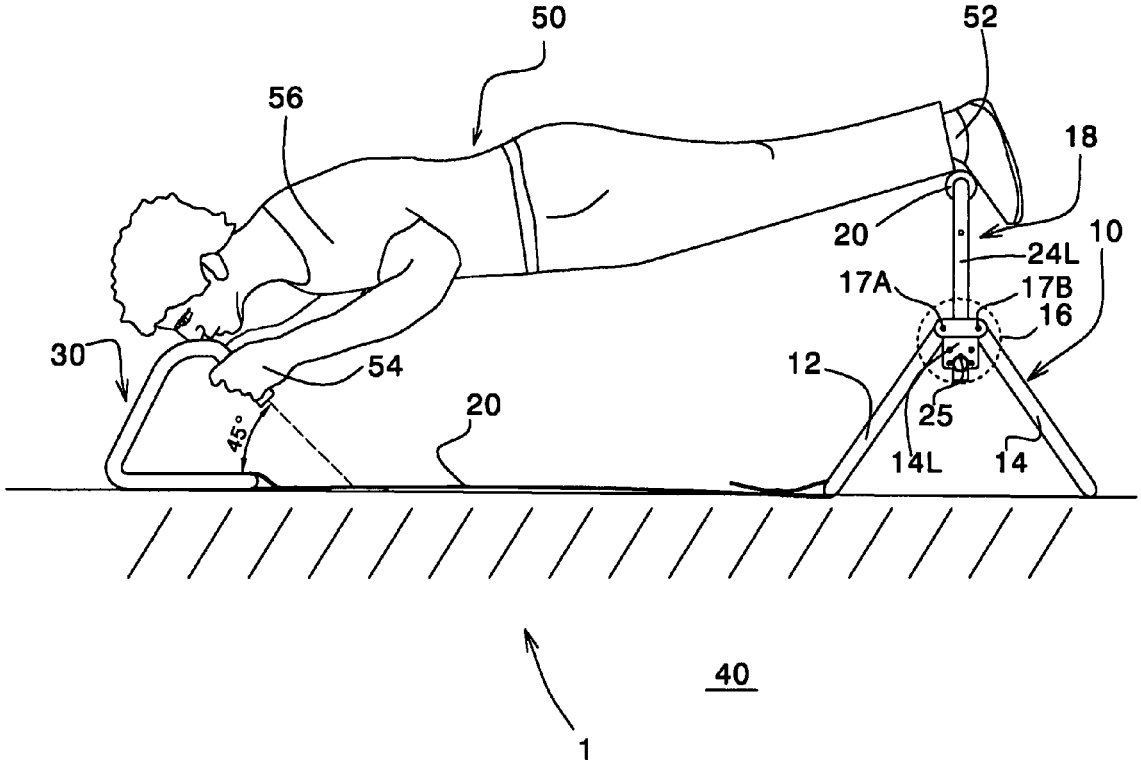
FIG. 1 is a cross sectional view of the apparatus of one embodiment of the present invention with an exerciser performing press ups thereon.
Figure 2:
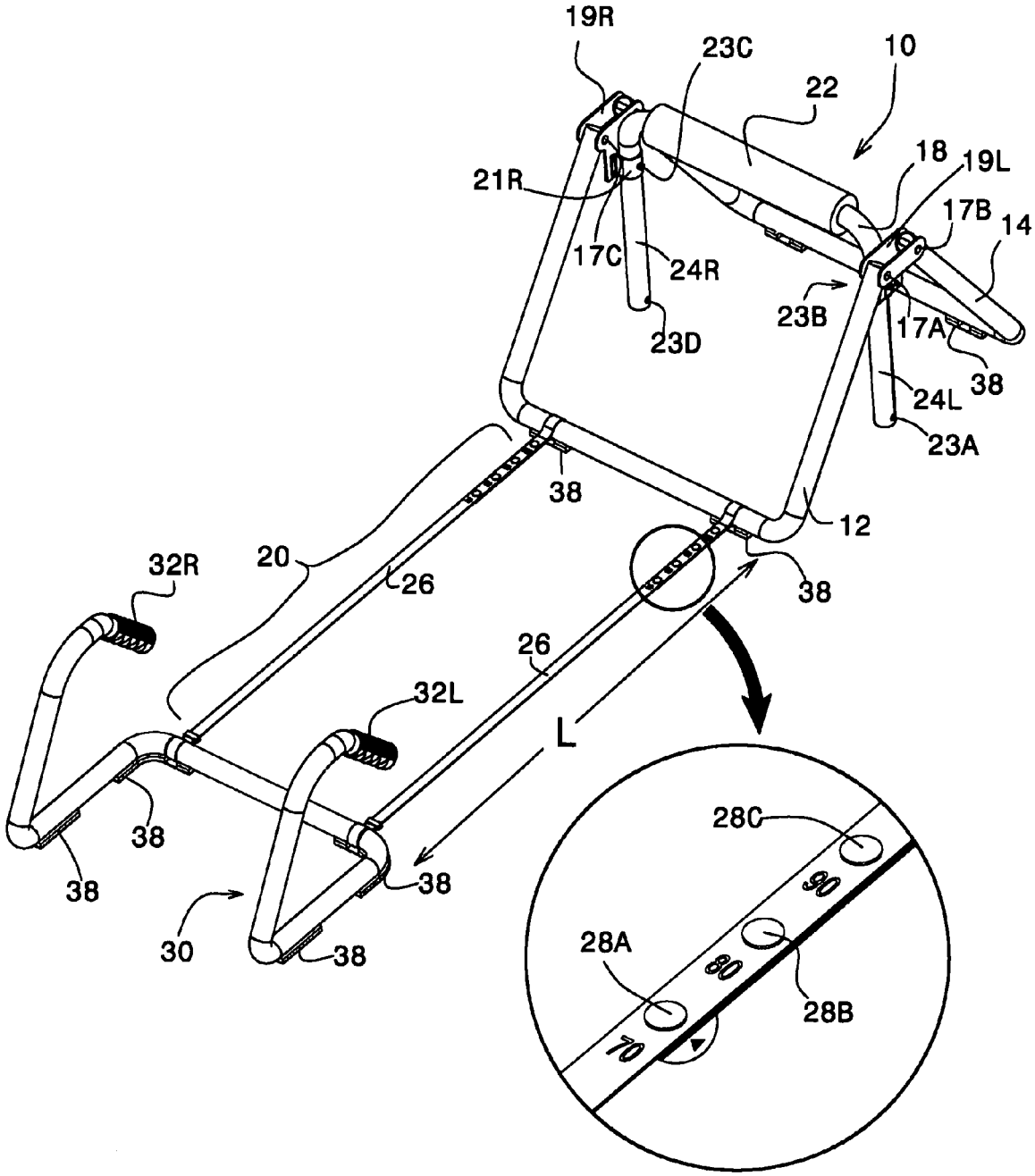
FIG. 2 is an isometric projection of the apparatus of FIG. 1, showing its construction and how it may be configured for use by persons of different stature, and having feet raised to different heights.

Referring now to FIGS. 1 and 2, a preferred embodiment of the portable push up apparatus 1 of the present invention is shown, comprising a foot supporter 10 coupled via a connecting means 20 to a hand supporter 30. The foot supporter 10 and the hand supporter 30 both rest on the ground 40. The foot supporter 10 comprises front 12 and back pieces 14 pivotably coupled at a join 16 and a foot support bar 18 comprising a crosspiece 22 and support legs 24L, 24R attached thereto, such that the height of the crosspiece 22 above the ground 40 may be varied. In FIG. 2, the foot support bar 18 is in its lower position and the crosspiece 22 is typically at a similar altitude to the hand grips 32L, 32R of the hand supporter 30. In contrast, in FIG. 1 the foot support bar 18 is shown in the raised position and the crosspiece 22 thereof is somewhat higher than the altitude to the handgrips 32L, 32R of the hand supporter 30. In consequence, the feet 52 of the exerciser 50 are raised above his/her hands 54, and, as explained hereinabove, elevating the feet 52 above the hands 54 while doing push-ups increases the resistance thereof, so that more work is done by the shoulders 56.

The separation of the foot supporter 10 from the hand supporter 30 may be varied by adjusting the length of the connecting means 20, which as shown in FIG. 2, may simply be a pair of straps 26 having variable length L by means of a buckle that engages different holes 28A, 28B, 28C therealong, in a similar manner to a conventional trouser belt, for example. Varying the separation between foot supporter 10 and hand supporter 30 enables the portable push up apparatus 1 to be adapted to users of different heights. Furthermore, it will be appreciated that the separation of crosspiece 22 and handgrips 32L, 32R is set by the height of the user, thus as the difference in relative heights of the crosspiece 22 and handgrips 32L, 32R is increased, the physical separation between the foot supporter 10 and the hand supporter 30 needs to be reduced for comfortable use by an exerciser.

To prevent skidding on smooth surfaces, typically grips 38, such as rubber grips, are provided on the undersurface of both the foot supporter 10 and the hand supporter 30.

As shown, the hand supporter 30 may resemble an inverted bicycle handlebar, having handgrips 32L, 32R at about 45° to the horizontal. One advantage of the portable push up apparatus 1 of the present invention is that it is more comfortable on the hands 54 of the exerciser 50 than conventional push ups performed by pressing against the ground.

The connecting means 20 may be permanently attached to the hand supporter 30 and/or to the foot supporter 10, for example, when comprising one or two straps 26, these may be looped therearound and riveted thereto. Alternatively, they may be fixed therearound or thereto by a popper stud, bolt or similar removable fixing means.

Figure 3:
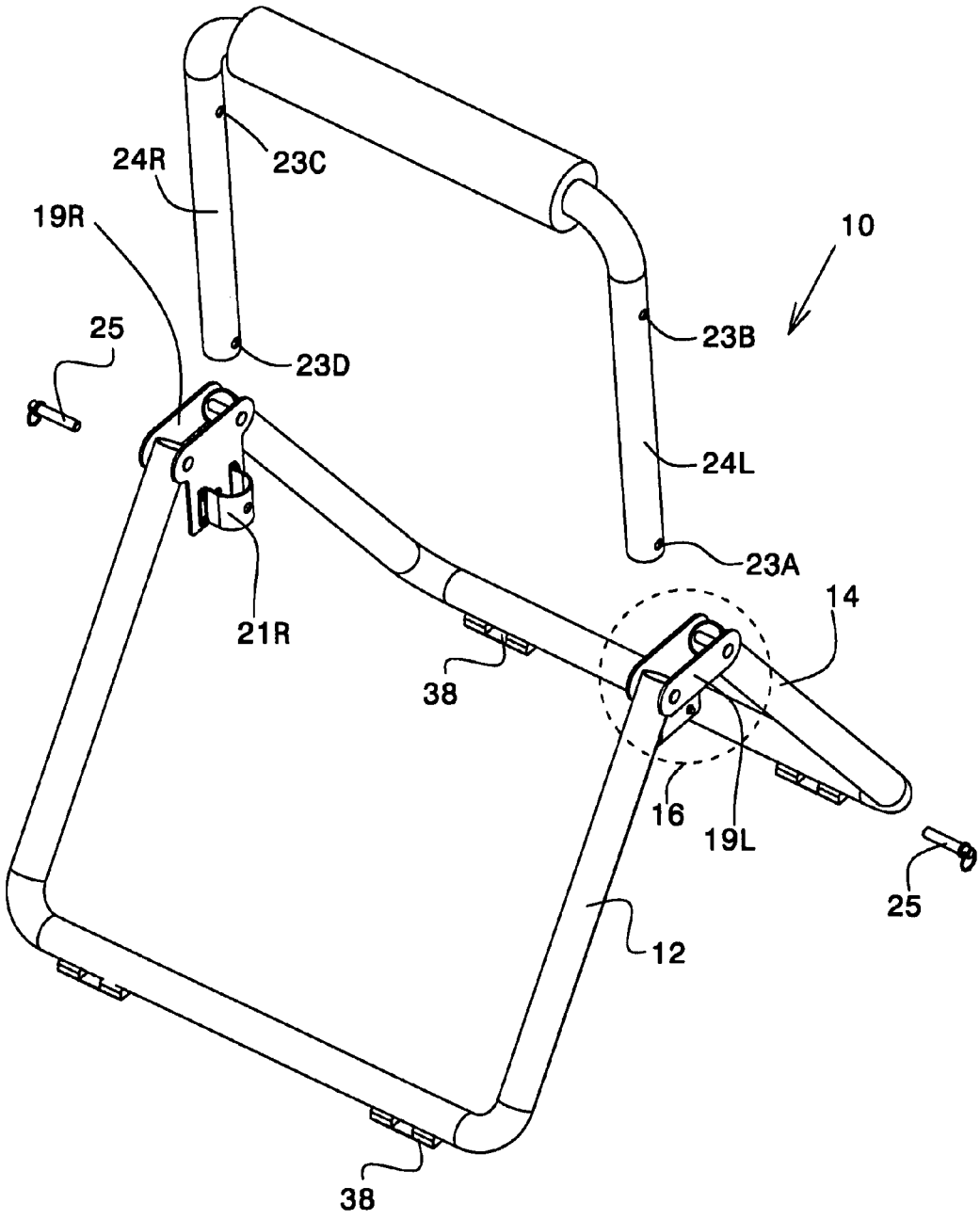
FIG. 3 is an exploded isometric projection of the foot support of the embodiment of FIG. 1.

As shown in FIG. 3, The front and back pieces 12, 14 of the foot supporter 10 may be connected together via a join 16 consisting of a pair of axles 17A, 17B, 17C, 17D on each side coupled by short connecting pieces 19L, 19R, and need not be connected via a single axle pin. Sockets 21L, 21R may be attached to such connecting pieces 19L, 19R, through which the vertical legs 24L, 24R of the foot support bar 18 are threaded. A plurality of holes 23A, 23B, 23C, 23D through the legs 24L, 24R and sockets 21L, 21R enable the height of the crosspiece 22 to be set by linchpins 25 therethrough. As shown, two such pairs of holes 23A, 23B, (23C, 23D) may be provided through each leg 24L (24R), enabling the foot supporter 10 of the apparatus 1 to assume lowered (FIG. 2) and raised (FIG. 1) positions. Alternatively, more such holes are provided at intermediate points therebetween to provide greater flexibility thereby.

Figure 4:
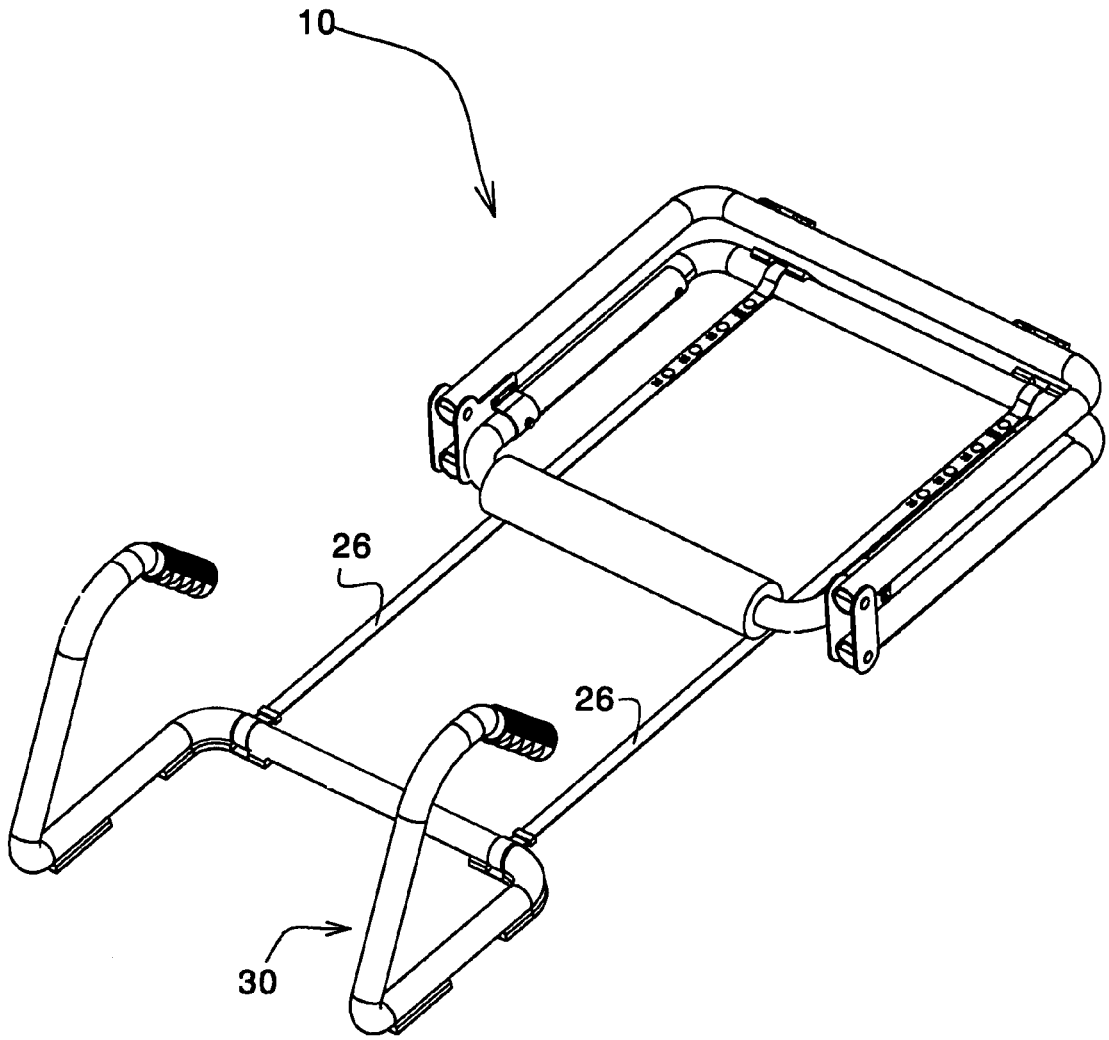
FIG. 4 shows how the embodiment may be folded away into a small volume for storage and transportation.

As shown in FIG. 4, preferably the foot supporter 10 may be folded flat. By wrapping the connecting means 20 therearound (not shown), the whole apparatus 1 can be folded away for storage and travel.

Figure 5:
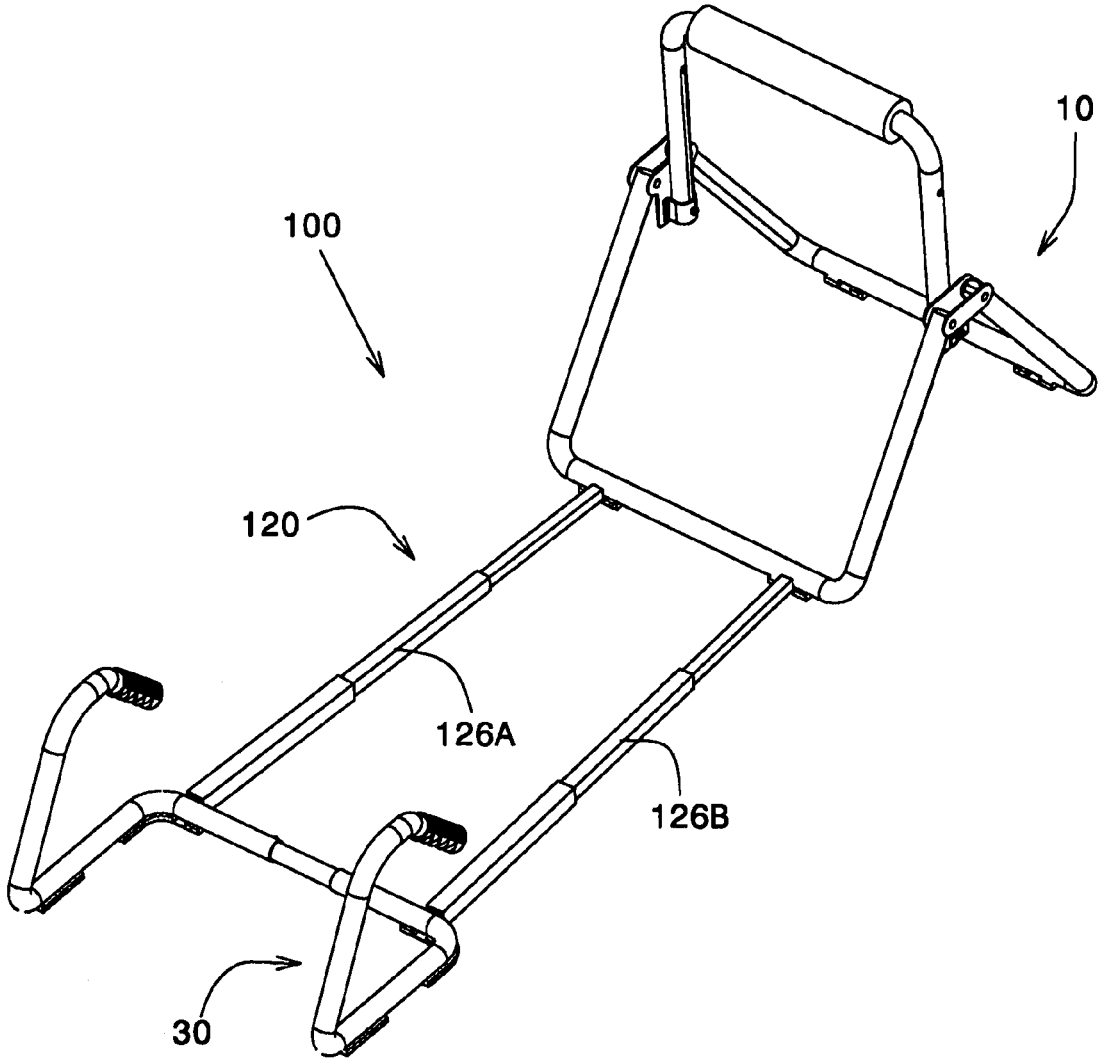
FIG. 5 shows an alternative embodiment in which the hand supporter and foot supporter are connected by a pair of telescopically extendible rods.

With reference to FIG. 5, in another embodiment of the exercise device 100, the connecting means 120 that connects the foot supporter 10 and hand supporter 30 may comprises a pair of telescopic rods 126A, 126B that may be extended or contracted telescopically.

Thus persons skilled in the art will appreciate that the present invention is not limited to what has been particularly shown and described hereinabove. Rather the scope of the present invention is defined by the appended claims and includes variations and modifications of the various features described hereinabove, which would occur to persons skilled in the art upon reading the foregoing description.

In the claims, the word "comprise", and variations thereof such as "comprises", "comprising" and the like indicate that the components listed are included, but not generally to the exclusion of other components.

The invention claimed is:

1. An apparatus for performing pushups thereupon, the apparatus being placed on a surface and comprising:

a. a foot supporter comprising:

i. a front piece, ii. a back piece, iii. a joint pivotably coupling said front piece of said foot supporter to said back piece of said foot supporter, and wherein said joint comprising a double axle coupled by a short connector, iv. a foot support bar comprising a crosspiece and support legs, wherein the height of the crosspiece above said surface is adjustable between a lowered position and a raised position;

b. a hand supporter;

c. a connecting means coupling said foot supporter to said hand supporter.

2. The apparatus of claim 1, wherein said hand supporter having handgrips thereon.

3. The apparatus of claim 2, wherein said handgrips being angled at about 45° to said surface.

4. The apparatus of claim 2, wherein when said foot supporter and said hand supporter are placed on a surface, and in said raised position said crosspiece is at a height further above said surface than said handgrips of said hand supporter.

5. The apparatus of claim 1 wherein separation of the foot supporter from the hand supporter is adjustable.

6. The apparatus of claim 5 wherein said length of said connecting means is variable by means of buckles for engaging different holes there-along.

7. The apparatus of claim 1 wherein said connecting means comprises a pair of straps.

8. The apparatus of claim 1 wherein said connecting means comprises a pair of telescopically extendible rods.

9. The apparatus of claim 1 further comprising rubber grips provided on undersurfaces of said foot supporter.

10. The apparatus of claim 1 further comprising rubber grips provided on undersurface of said hand supporter.

11. The apparatus of claim 1 wherein said hands supporter resembles an inverted bicycle handlebar having hand grips angled at about 45° to said surface.

12. The apparatus of claim 1 further comprising a socket attached to said connector, for engaging vertical legs of said foot support bar by threading said legs therethrough.

13. The apparatus of claim 12 further comprising a plurality of holes through said legs and said socket for enabling altitude of the crosspiece above said surface to be adjusted by placing a linchpin therethrough.

14. The apparatus of claim 13, wherein the foot supporter is foldable to a substantially flattened configuration.

* * * * *